US007029290B2

(12) United States Patent
Wu

(10) Patent No.: US 7,029,290 B2
(45) Date of Patent: Apr. 18, 2006

(54) CABLE CONNECTOR ASSEMBLY HAVING IMPROVED MATING PORT

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/911,442

(22) Filed: Aug. 3, 2004

(65) Prior Publication Data

US 2006/0030172 A1 Feb. 9, 2006

(51) Int. Cl.
*H01R 12/00* (2006.01)

(52) U.S. Cl. ..... 439/76.1
(58) Field of Classification Search ..... 439/76.1, 439/701, 638
See application file for complete search history.

(56) References Cited

U.S. PATENT DOCUMENTS 5,125,854 A * 6/1992 Bassler et al. ..... 439/607
5,567,169 A 10/1996 Marsh et al.
6,776,658 B1 * 8/2004 Tang ..... 439/607

* cited by examiner

*Primary Examiner*—Ross Gushi
(74) *Attorney, Agent, or Firm*—Wei Te Chung

(57) ABSTRACT

A cable connector assembly (1) comprises a shell (2, 3) having a mating frame (32), a first tongue portion (42*a*) having a number of first contacts (422*a*) therein, and a second tongue portion (42*b*) having a number of second contacts (422*b*) therein. The first tongue portion and the second tongue portion are disposed in the mating frame in a side-by-side manner, thereby corporately forming a unitary mating port enabling transmitting data at a high speed. As there no new equipments or innovated procedure is needed, the cost of the cable connector assembly is sharply cut down both in inventory and manufacturing.

17 Claims, 6 Drawing Sheets

CABLE CONNECTOR ASSEMBLY HAVING IMPROVED MATING PORT

BACKGROUND OF THE INVENTION

1. Field of the Invention

The present invention generally relates to a cable connector assembly, and more particularly to a cable connector assembly having improved mating port.

2. Description of Related Art

A cable and connector unit, in which connectors are connected with both ends of the cable, is used for connecting two electronic devices. With the recent development of personal computers and networks, systems thereof are required for transmitting a large amount of data at a relative high speed, which results in a requirement of an electrical connector having a mating port enabling transmitting the data at a high speed. A method of increasing data transmitting speed of the cable connector assembly is to assemble more conductive signal contacts therein. According to this approach, for disposing more contacts in the connector, new or improved equipments and new moulds are required for accommodating manufacturing of the connector, thereby inevitable increasing the cost both in inventory and manufacturing. Further, the electrical connector having so many contacts is complicated in manufacturing, especially in soldering the contacts to a printed circuit board or terminating to a cable set.

Hence, a cable connector assembly having an improved mating port is desired to overcome the disadvantages of the related art.

BRIEF SUMMARY OF THE INVENTION

Accordingly, an object of the present invention is to provide a cable connector assembly having a high-speed transmitting mating port as well as maintaining a low cost.

In order to achieve the above-mentioned object, a cable connector assembly in accordance with the present invention comprises a shell having a mating frame, a first tongue portion having a plurality of first contacts therein, and a second tongue portion having a plurality of second contacts therein. The first tongue portion and the second tongue portion are disposed in the mating frame in a side-by-side manner, thereby corporately forming a unitary mating port enabling high-speed transmission. As there no new equipments or innovated procedure is needed, the cost of the cable connector assembly is sharply cut down both in inventory and manufacturing.

Other objects, advantages and novel features of the invention will become more apparent from the following detailed description of the present embodiment when taken in conjunction with the accompanying drawings.

DETAILED DESCRIPTION OF THE INVENTION

Figure 1:
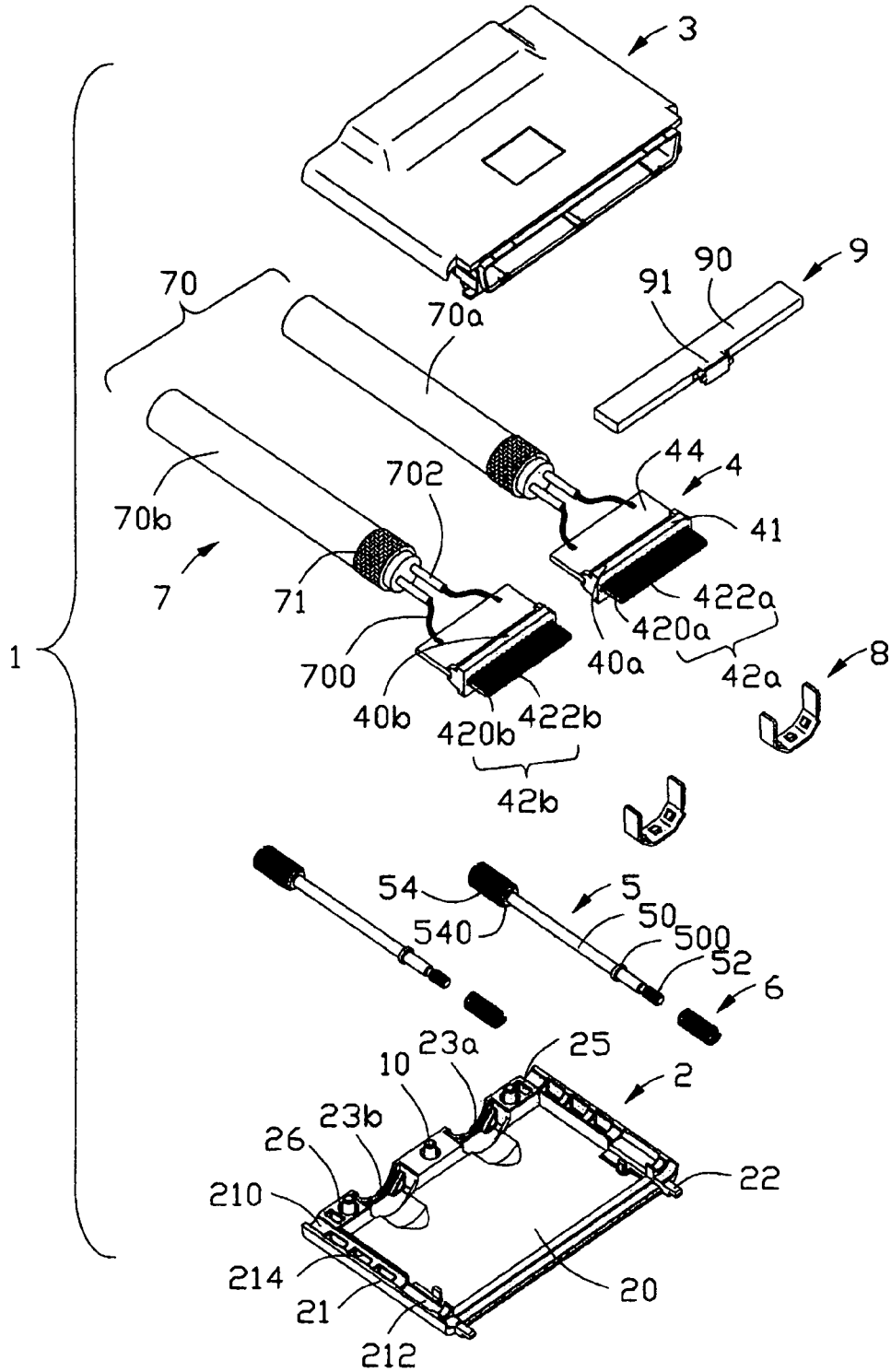
FIG. 1 is an exploded, perspective view of a cable end connector assembly in accordance with the present invention.

Reference will now be made to the drawing figures to describe the present invention in detail.

Figure 2:
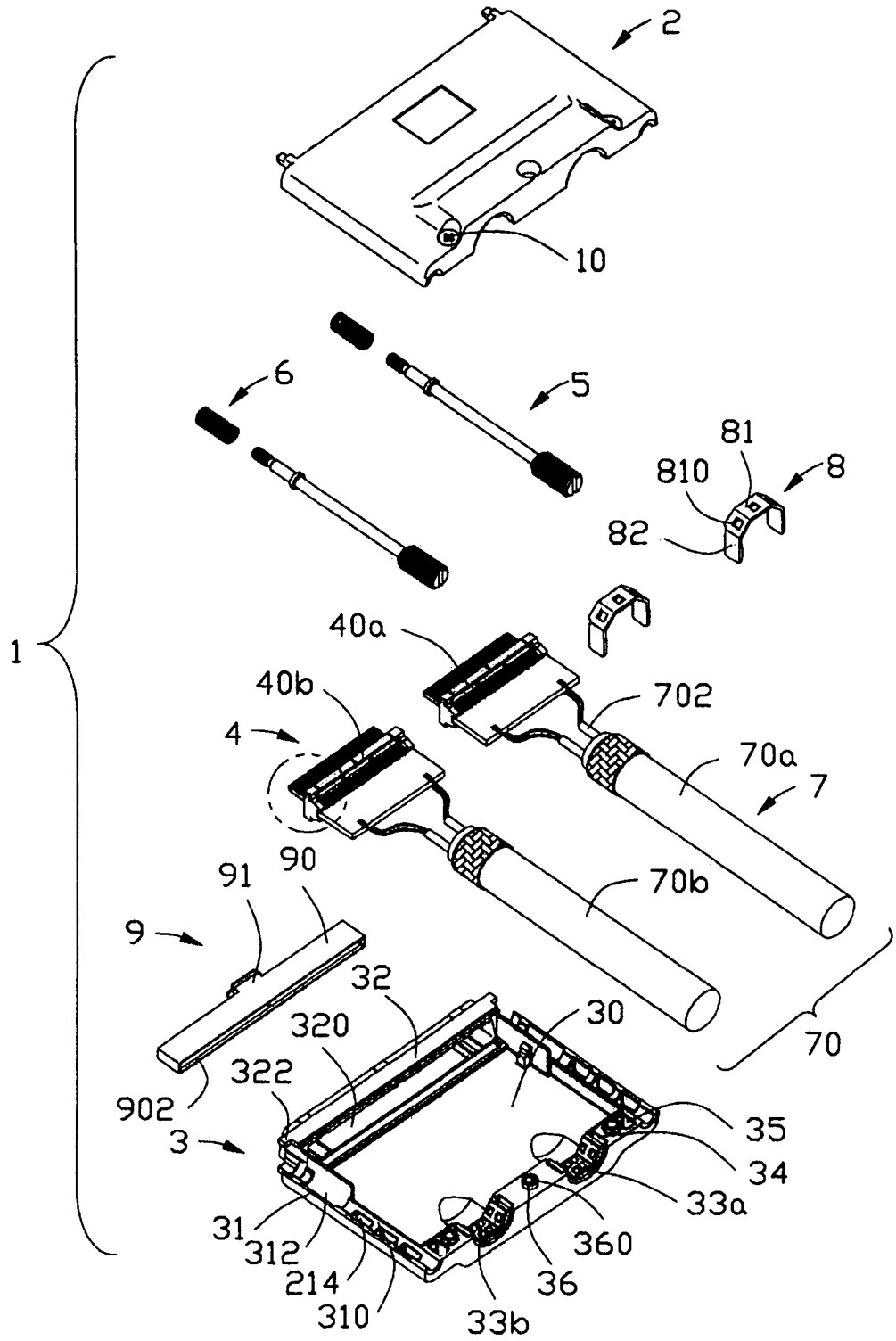
FIG. 2 is a view similar to FIG. 1, but taken from a different aspect.

Referring to FIGS. 1–2, a cable connector assembly 1 in accordance with the present invention comprises an upper die cast cover 2, a lower die cast cover 3, a sub-connector 4, a pair of fastening members 5, a pair of spring members, a cable set 7, a pair of strain relieves 8, a dustproof member 9 and a pair of screws 10.

The upper cover 2 comprises a generally planner cover plate 20 and a pair of flanges 21 extending downwardly from opposite lateral sides of the cover plate 20. Each flange 21 defines a first channel 210 extending through a whole length thereof. The first channel 210 comprises a first recessed portion 212 at a front portion thereof. The first recessed portion 212 recesses more deeply and widely than other portions of the first channel 210. A pair of projections 22 extends forwardly from opposite sides of a front end of the cover plate 20. A pair of spaced substantially semicircular first opening 23*a*, 23*b* is defined at a rear end of the cover plate 20. A pair of first receiving holes 25 is defined at the rear end of the cover plate 20 adjacent to the flanges 21. Three holes 26 are defined at the rear end and spaced from each other by the two openings 23*a*, 23*b*.

The lower cover 3 comprises a base plate 30 and a pair of flanges 31 upwardly extending from opposite lateral sides of the base plate 30. Each flange 31 defines a second channel 310 corresponding to the first channel 210 of the upper cover 2. Each second channel 310 comprises a second recessed portion 312 corresponding to the first recessed portion 212. A mating frame 32 is formed at a front end of the lower cover 3. The mating frame 32 defines an opening 320 therethrough. A pair of engaging ears 322 is formed on opposite top sides of the mating frame 32 and extends laterally. A pair of semicircular second openings 33*a*, 33*b* is defined in a rear end of the base plate 30 corresponding to the first openings 23*a*, 23*b* of the upper cover 2. Two pairs of vertical grooves 34 are respectively located on opposite lateral sides of each second opening 33*a*, 33*b*. A pair of second receiving holes 35 is defined at the rear end of the lower cover 4 corresponding to the first receiving holes 25. Three posts 46 protrude upwardly and locate in positions corresponding to the holes 26 of the upper cover 2. Each post 36 defines a screw hole 360 therein. For reducing the weight of the cover 2, 3, each of the flanges 21, 31 defines a plurality of cutouts 214 therein.

Figure 3:
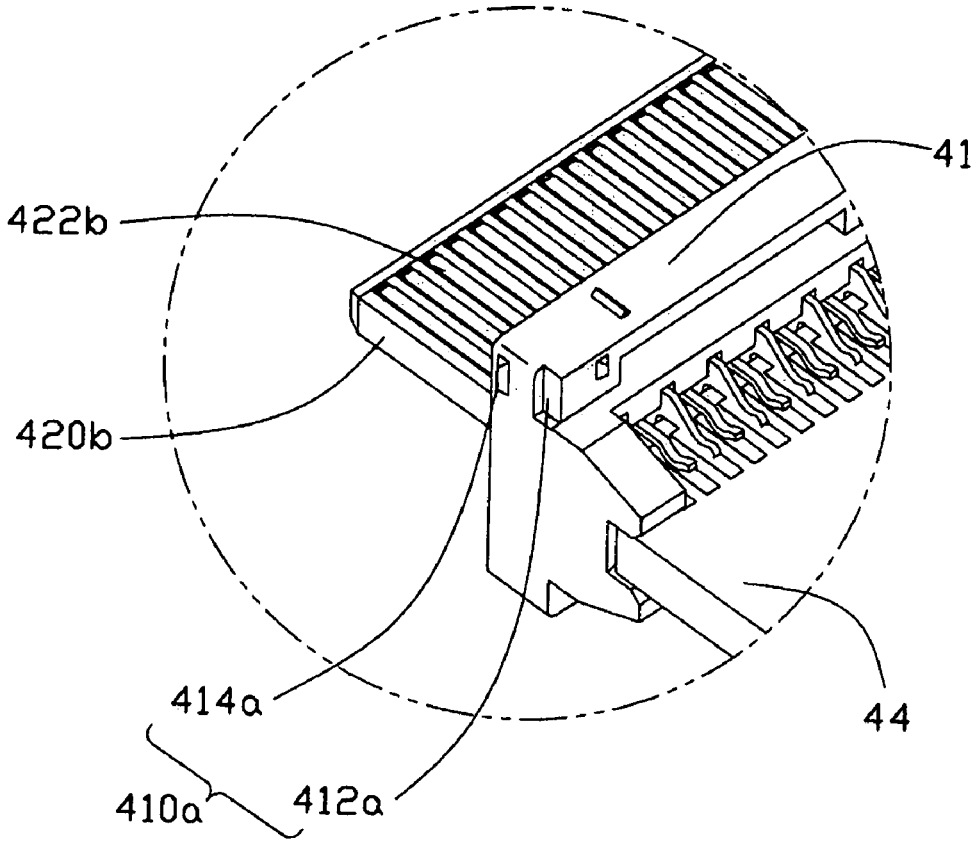
FIG. 3 is an enlarged view of an encircled area of FIG. 2.

The sub-connector 4 is formed with two interconnected terminal modules 40*a*, 40*b*. In this embodiment, the two interconnected terminal modules 40*a*, 40*b* have the same structure. The terminal module 40*a* comprises an insulative base 41, a first tongue portion 42*a* at a front side thereof, a circuit board 44 assembled to the base 41 at a rear side thereof. The first tongue portion 42*a* is formed with a tongue board 420*a* extending forwardly from the base 41 and a plurality of first contacts 422*a* received in the tongue board 420*a*. The second tongue portion 42*b* is formed with a forwardly extending tongue board 420*b* and a plurality of second contacts 422*b* received in the tongue board 420. Both the first and the second contacts 422*a*, 422*b* are electrically connected with the corresponding circuit boards 44. Particularly shown in FIG. 3, for interconnecting the two terminal modules 40*a*, 40*b*, each base 41 provides coupled first and second engaging members 410*a*, 410*b* (not shown) on opposite top ends thereof. On one end of the base 41, the first engaging member 410*a* is formed with a protrusion 414*a* near the circuit board 44, and a cutout 412*a* opened toward the tongue board 42 and profiled to receive the protrusion 414. On another end of the base 41, the second engaging member 410*b* is composed of a protrusion 414*b* and a cutout 412*b*, and they are provided in positions opposite to that of the first engaging member 410*a*.

Each of the fastening member 5 is generally cylindrical and comprises an elongated medial portion 50, a threaded portion 52 extending forwardly from the medial portion 50, and an operating portion 54 extending rearwardly from the medial portion 50. The medial portion 50 comprises an annular stop portion 500 at a front end protruding outwardly from a periphery face thereof. The operating portion 54 has a contacting portion 540 connecting with a rear end of the medial portion 50. An outer surface of the operating portion is slotted for facilitating handling.

The cable set 7 is composed of two individual cables 70*a*, 70*b*. Each cable 70 comprises a plurality of lines 702 therein. Each line 702 has a plurality of conductors 700 electrically terminated to the circuit board 44 of the terminal module 40. Each cable 70 further has a conductive shield 71 surrounding the lines 702 to be clamped between the upper and lower covers 2, 3.

The strain relieves 8 are typically made of conductive material with high rigidity. Each strain relief 8 comprises an arcuate bight 81 and a pair of legs 82 extending downwardly from bottom ends of the bight 81. The bight 81 has a plurality of tabs 810 punched inwardly.

The dustproof cover 9 has an elongated main portion 90 and a handling portion 91 outwardly protruding from a middle portion of the main portion 90. The main portion 90 defines a space 902 for receiving the tongue portions 43 therein.

Figure 4:
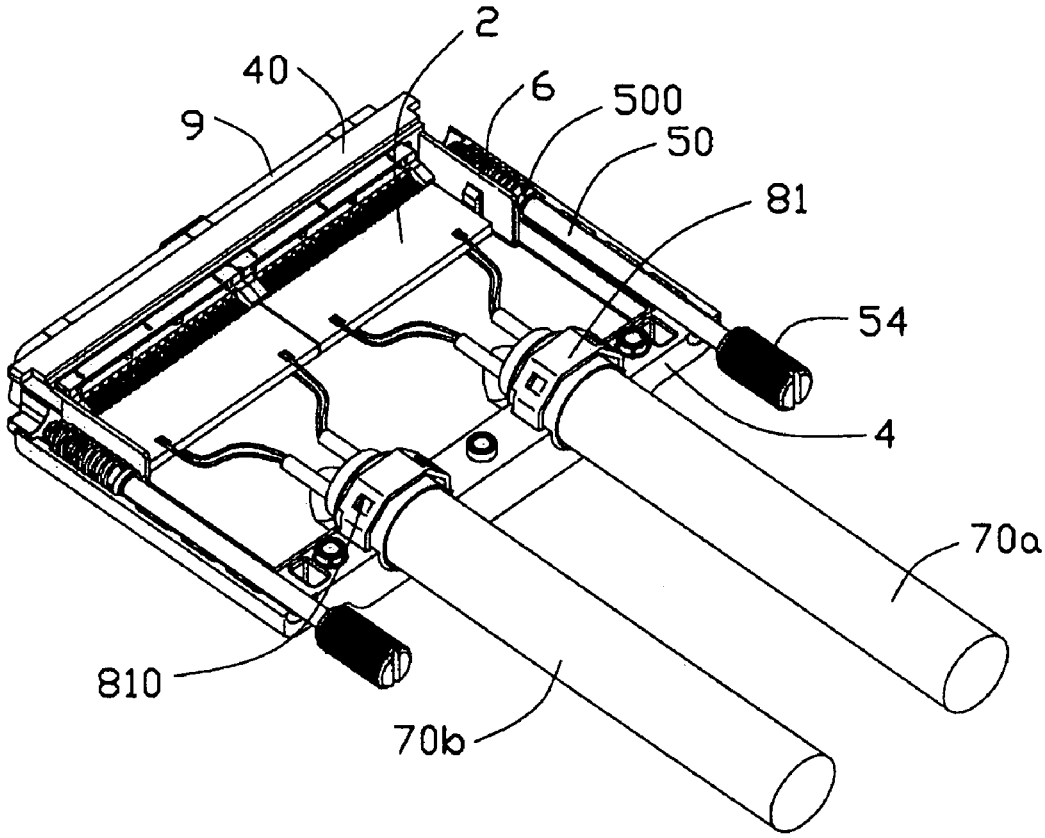
FIG. 4 is an assembled view before an upper cover shown in FIG. 2 assembled.

Referring to FIG. 4, the two terminal modules 40 are assembled to the lower cover 3 in a juxtaposed manner. The two bases 41 are interconnected with each other, with first engaging member 410*a* formed on one end of the first terminal module 40*a* coupled with second engaging member 410*b* disposed on one end of the second terminal module 40*b*. The protrusion 414*a* is received in the cutout 412*b* and the protrusion 414*b* is fit into the cutout 412*a*. The two tongue portions 42 are disposed in the cavity 320 of the mating frame 32, whereby forms a unitary mating port adapted for mating with a complementary connector. In this manner, a mating port enabling high-speed transmission is obtained. As there no new equipments or innovated procedure is needed, the cost of the cable connector assembly 1 is sharply cut down both in inventory and manufacturing. When the cable connector assembly 1 is unemployed, the dustproof cover 9 fittingly encloses the side-by-side tongue portions 42 for preventing the contacts 43 from dust. The cables 70*a* and 70*b* are respectively terminated to the circuit boards 44 with the conductive shields 71 respectively received in the first openings 33*a*, 33*b*. The bight 81 of each strain relief 8 encircles the conductive shield 71 and the tabs 810 are bitten into the conductive shied 71 to secure a corresponding cable 70 in place. The pair of legs 82 of each strain relief 8 is inserted into corresponding pair of grooves 34. Each of the spring members 6 is assembled to a corresponding fastening member 5. The fastening members 5 with spring members 6 thereon are disposed in the second channels 322 of the lower cover 3, with the stop section 500 being located at a rear end of the second recessed portion 324, and with the spring members 6 respectively received in the second recess portions 324.

Figure 5:
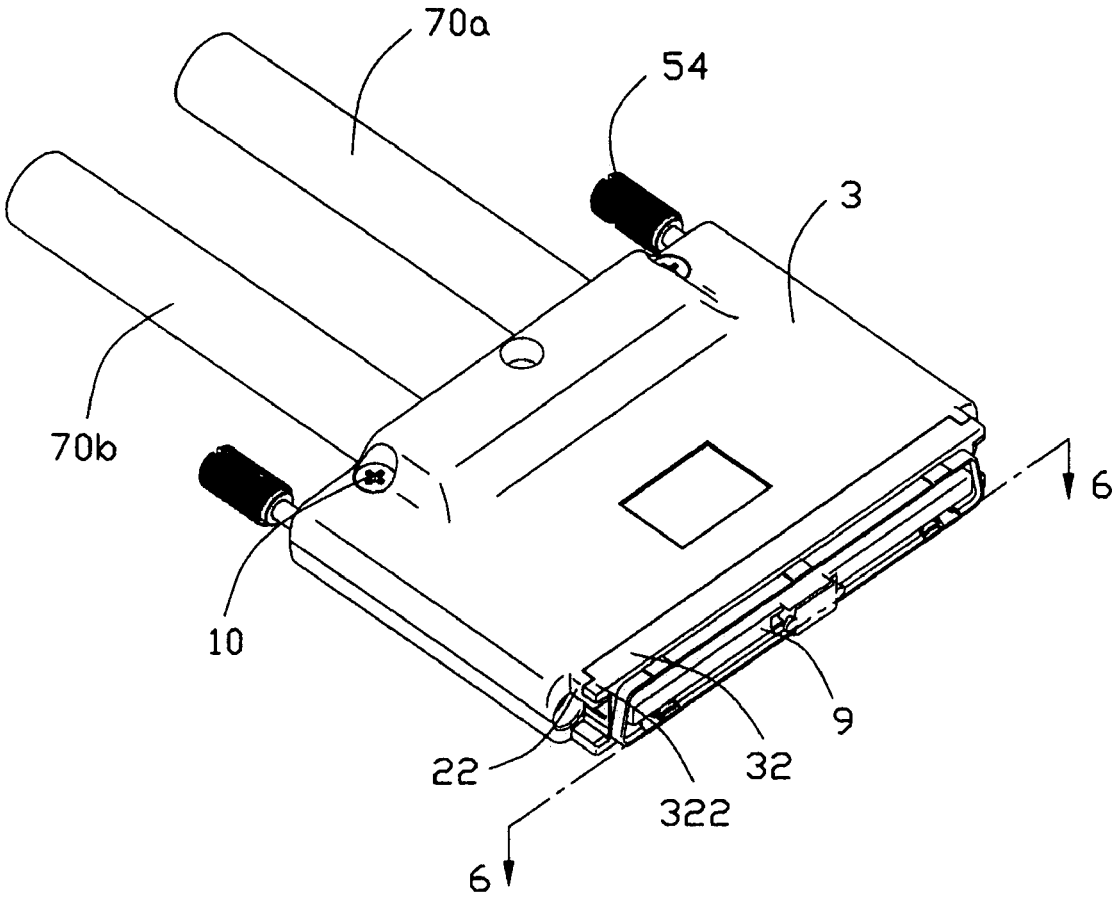
FIG. 5 is an perspective, assembled view of the cable end connector assembly shown in FIG. 1.
Figure 6:
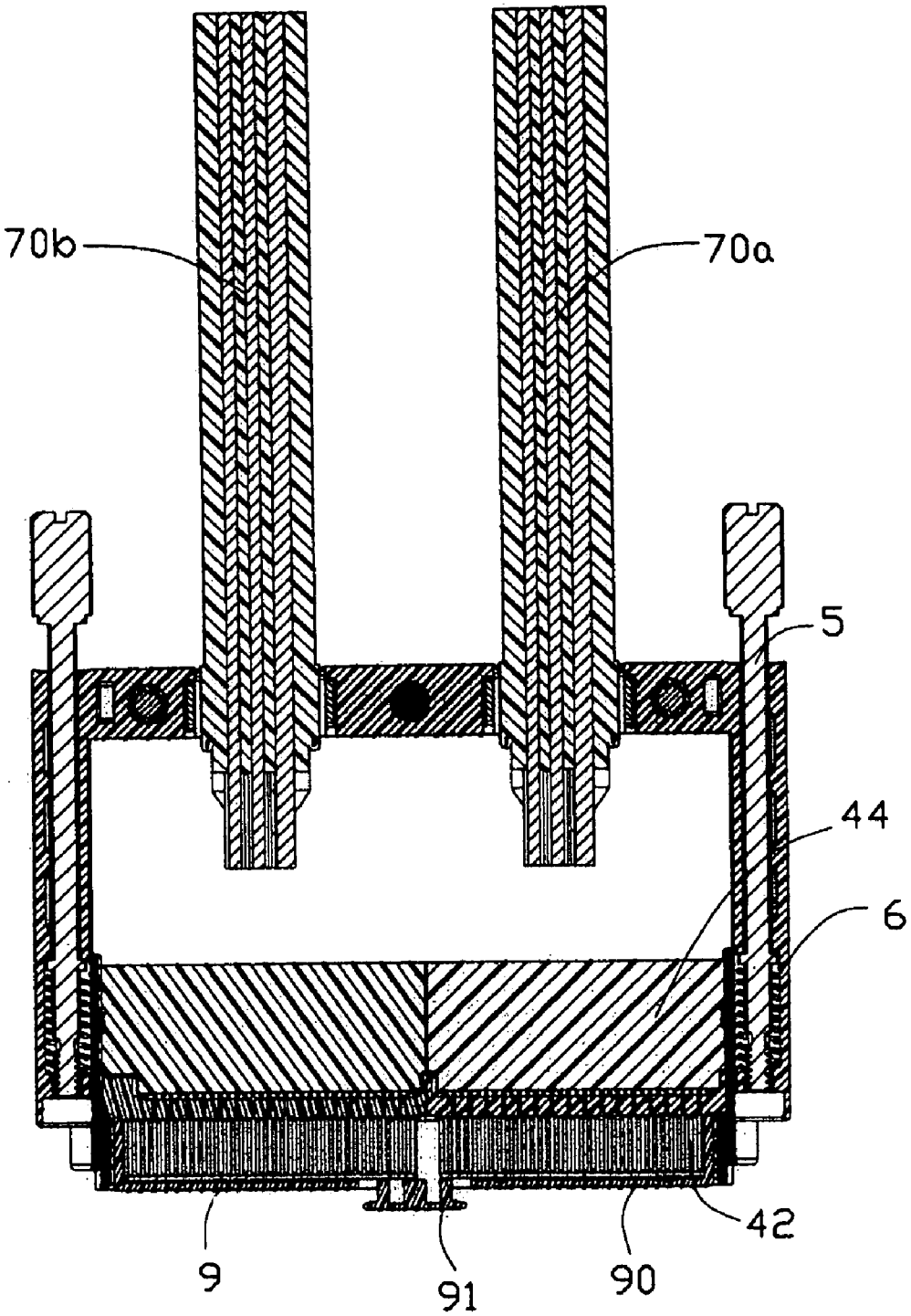
FIG. 6 is a cross-sectional view taken along line 6—6 of FIG. 5.

Referring to FIG. 5 and in conjunction with the FIGS. 1–4, the upper cover 2 is assembled to the lower cover 2 with the projections 22 located below the engaging ears 322. The three screws 10 are then pass through corresponding holes 26 defined in the upper cover 2 and into corresponding screw holes 360 defined in the lower cover 3 to thereby coupling the upper cover 2 to the lower cover 3.

In the preferred embodiment, the unitary mating port is formed by two interconnected, juxtaposed tongue portions, and the two tongue portions have equal number of contacts disposed thereon. However, the unitary mating port could be formed by plural tongue portions, which have equal/unequal number of contacts, upon requirements in certain applications. Moreover, although the tongue portions with contacts thereon in the preferred embodiment are connected with the cable set via the circuit boards, the contacts assembled in the tongue portions could be directly soldered to a printed circuit board or a cable set, if desired.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

The invention claimed is:

1. An electrical connector, comprising:

a shell having a continuous mating frame;

a first tongue portion having a plurality of first contacts therein disposed in the mating frame; and a second tongue portion assembling a plurality of second contacts thereon disposed in the mating frame;

wherein the first tongue portion and the second tongue portion are disposed substantially in a same level at an interval;

a first and a second terminal modules enclosed by the shell and respectively having the first end the second contacts therein, the first tongue portion and the second tongue portion respectively formed at front ends thereof;

wherein the first and the second terminal modules comprise coupled engaging members thereon for interconnecting with each other.

2. The electrical connector as claimed in claim 1 comprising a cable set terminated to the first and the second tongue portions.

3. The electrical connector as claimed in claim 2, wherein the cable set comprises a plurality of lines therein, the lines divided into two groups respectively terminated to the first and the second tongue portions in a one-to-one relationship.

4. The electrical connector as claimed in claim 2, wherein the cable set is composed of two individual cables, the two cables connected with the first and the second tongue portions in a one-to-one relationship.

5. The electrical connector as claimed in claim 1, wherein both the first and the second terminal modules have circuit boards disposed opposite to the first and the second tongue portions and electrically connected with the corresponding contacts.

6. The electrical connector as claimed in claim 1, wherein the shell defines two receiving holes for extension of the cable set.

7. The electrical connector as claimed in claim 1 comprising a pair of fastening members assembled to the shell.

8. The electrical connector as claimed in claim 2 comprising a strain relief assembled to the shell, and wherein the cable set is secured between the strain relief and the shell.

9. The electrical connector as claimed in claim 8, wherein the strain relief comprises an arcuate bight encircling the cable set and a pair of legs retained to the shell.

10. The electrical connector as claimed in claim 1, wherein the shell is formed with an upper cover and a lower cover.

11. The electrical connector as claimed in claim 10, wherein the mating frame is formed on the lower cover.

12. An electrical connector comprising:

a cover device defining on a front portion thereof a mating frame with a mating opening;

first and second cables connected to the corresponding opening in a rear portion to receive the corresponding first and second cables, respectively;

said cover device defining a pair of connecting openings in a rear portion to receive the corresponding first and second cables, respectively; wherein said cover device includes upper and lower cover halves assembled together to sandwich the first and second connectors and the first and second cables therebetween; and wherein the electrical connector further includes first and second printed circuit boards to connect the corresponding first connector and first cable, and the corresponding second connector and second cables, respectively.

13. The electrical connector as claimed in claim 12, wherein said first connector and said second connector include respectively first and second mating tongue portions commonly received in the mating opening.

14. The electrical connector as claimed in claim 13, wherein said mating tongue portions are spaced from each other with a distance.

15. The electrical connector as claimed in claim 14, wherein said distance is measured along a horizontal direction.

16. an electrical connector comprising:

a cover device defining on a front portion thereof a mating fame with a mating opening;

first and second connectors side by side disposed in the same mating frame, each of said first and second connectors defining a mating tongue located in the mating opening;

first and second cables connected to the corresponding first and second connectors, respectively; and a common dust cover located in the mating portion and covering the mating tongues of both of said first and second connectors.

17. The electrical connector as claimed in claim 16, further including a pair of screws located by two sides of the cover device.

* * * * *